United States Patent [19]

Dirksing

[11] Patent Number: 4,730,381

[45] Date of Patent: Mar. 15, 1988

[54] METHOD OF MAKING PLURAL-CHAMBERED DISPENSING DEVICE EXHIBITING CONSTANT PROPORTIONAL CO-DISPENSING

[75] Inventor: Robert S. Dirksing, Cincinnati, Ohio

[73] Assignee: The Procter & Gamble Company, Cincinnati, Ohio

[21] Appl. No.: 17,122

[22] Filed: Feb. 20, 1987

Related U.S. Application Data

[62] Division of Ser. No. 844,919, Mar. 27, 1986, Pat. No. 4,678,103.

[51] Int. Cl.[4] ..... B23P 11/02

[52] U.S. Cl. ..... 29/451; 29/455 R; 29/523; 29/DIG. 44

[58] Field of Search ..... 29/421 R, 451, 455 R, 29/523, DIG. 44, 450; 53/408, 452, 474; 222/94, 136, 129, 130

[56] References Cited

U.S. PATENT DOCUMENTS

| | | | |
|---|---|---|---|
| 2,205,147 | 6/1940 | Madsen . | |
| 2,469,032 | 5/1949 | Chaudron | 222/130 X |
| 2,661,870 | 12/1953 | Huenergardt | 222/129 |
| 2,734,473 | 2/1956 | Reynolds | 29/421 X |
| 2,847,959 | 8/1958 | Switzer | 29/421 X |
| 2,873,887 | 2/1959 | Spero | 222/94 |
| 2,939,610 | 6/1960 | Castelli et al. | 222/94 |
| 2,941,696 | 6/1960 | Homm | 222/136 |
| 2,944,704 | 7/1960 | Taylor, Jr. | 222/94 |
| 2,973,883 | 3/1961 | Modderno | 222/94 |
| 3,068,561 | 12/1962 | Jones | 29/421 R X |
| 3,076,573 | 2/1963 | Thomas | 215/6 |
| 3,135,428 | 6/1964 | Gallo, Sr. | 222/94 |
| 3,197,071 | 7/1965 | Kuster | 222/94 |
| 3,200,995 | 8/1965 | Gangwisch | 222/94 |
| 3,206,074 | 9/1965 | Hoffmann | 222/94 |
| 3,217,931 | 11/1965 | Farrar et al. | 222/94 |
| 3,255,926 | 6/1966 | Modderno | 222/136 |
| 3,269,389 | 8/1966 | Meurer et al. . | |
| 3,330,122 | 7/1967 | Janner | 29/421 X |
| 3,347,420 | 10/1967 | Donoghue | 222/129 |
| 3,416,709 | 12/1968 | Shultz et al. | 222/94 |
| 3,450,254 | 6/1969 | Miles . | |
| 3,467,269 | 9/1969 | Newton | 215/6 |
| 3,472,423 | 10/1969 | Kaplan | 222/129 |
| 3,506,157 | 4/1970 | Dukess | 222/94 |
| 3,590,989 | 7/1971 | Wittwer . | |
| 3,603,485 | 9/1971 | Vivier | 222/129 |
| 3,729,553 | 4/1973 | Gold et al. | 424/44 |
| 3,776,775 | 12/1973 | Lazarus | 134/42 |
| 3,850,346 | 11/1974 | Richardson et al. | 222/145 |
| 3,851,800 | 12/1974 | Swain | 222/145 |
| 3,921,273 | 11/1975 | Kondo et al. | 29/451 X |
| 4,022,351 | 5/1977 | Wright | 222/145 |
| 4,065,536 | 12/1977 | Lucas | 264/98 |
| 4,089,437 | 5/1978 | Chutter et al. | 222/94 |
| 4,125,207 | 11/1978 | Ernst et al. | 222/130 |
| 4,148,417 | 4/1979 | Simmons | 222/94 |
| 4,273,161 | 6/1981 | McLaughlin | 29/450 X |
| 4,279,349 | 7/1981 | Aigner | 215/6 |
| 4,449,651 | 5/1984 | Roder et al. | 222/455 |
| 4,483,439 | 11/1984 | Steigerwald et al. . | |
| 4,563,186 | 1/1986 | Flynn et al. | 8/137 |
| 4,585,150 | 4/1986 | Beacham et al. | 222/129 |

FOREIGN PATENT DOCUMENTS

| | | |
|---|---|---|
| 157653 | 10/1985 | European Pat. Off. . |
| 2901952 | 7/1980 | Fed. Rep. of Germany . |
| 2946063 | 7/1980 | Fed. Rep. of Germany . |

*Primary Examiner*—Charlie T. Moon

*Attorney, Agent, or Firm*—John J. Ryberg; E. Kelly Linman; John V. Gorman

[57] ABSTRACT

A plural-chambered, gravity-activated dispensing device that incrementally dispenses two or more flowable products at a substantially constant, predetermined ratio. In one preferred embodiment of the present invention, an inner container is positioned within an outer container, each container defining a chamber adapted to contain a flowable product, and having a discharge opening therein. An empty third container is sized and positioned within the inner container to impose on the inner chamber's pouring characteristics an effect similar to that imposed on the outer chamber's pouring characteristics by the inner container to thereby achieve a substantially constant dispensing ratio between the pourable products dispensed therefrom. In another particularly preferred embodiment, the effect of the third empty container mentioned above is superimposed on the inner container's shape and position within the outer container, thereby eliminating the third empty container. Also provided are a unique pouring spout and sealing cap to be used in conjunction with dual-chambered dispensing devices of the present invention, as well as a method of making such dispensing devices.

13 Claims, 12 Drawing Figures

PRIOR ART

Fig. 6
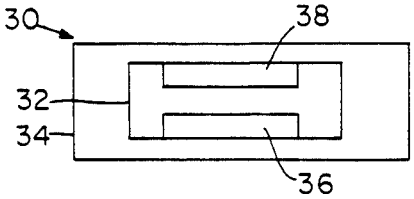
Fig. 8
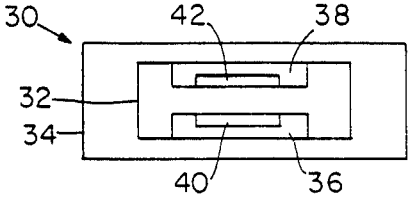
Fig. 5
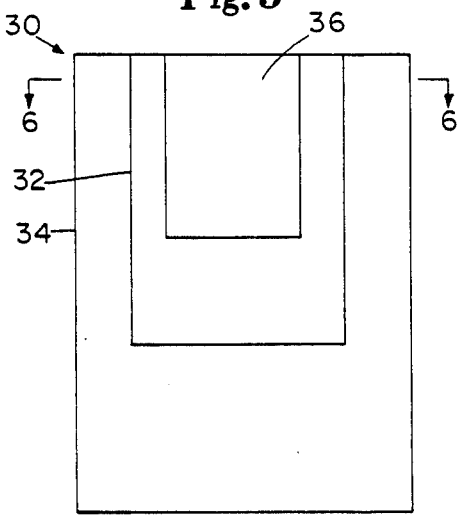
Fig. 7
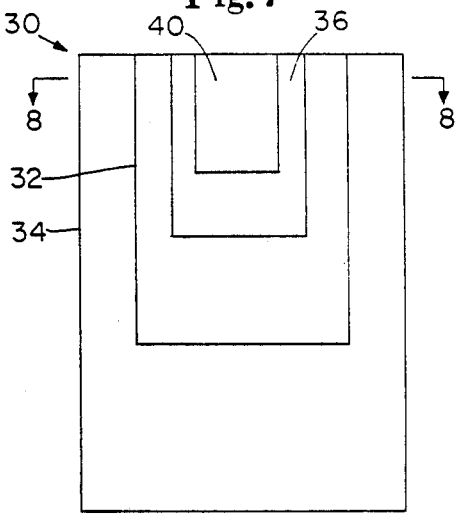
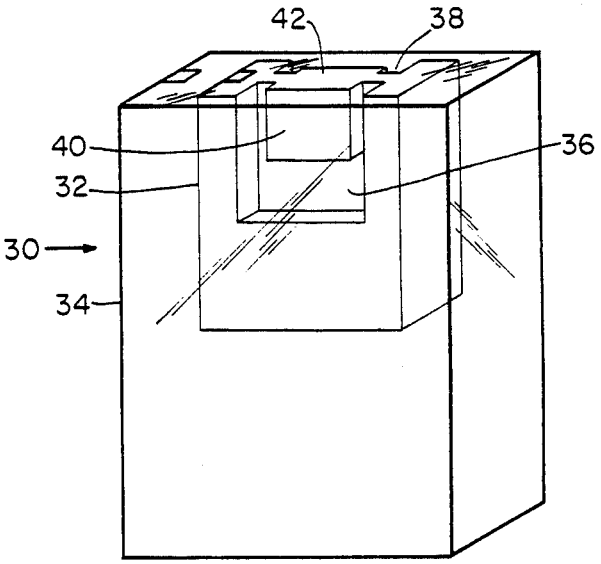
Fig. 9

METHOD OF MAKING PLURAL-CHAMBERED DISPENSING DEVICE EXHIBITING CONSTANT PROPORTIONAL CO-DISPENSING

This is a division of application Ser. No. 844,919, filed on Mar. 27, 1986, now Pat. No. 4,678,103.

TECHNICAL FIELD

The present invention pertains to plural-chambered dispensing devices for simultaneously dispensing two or more flowable products, and more particularly to plural-chambered, gravity-activated dispensing devices that incrementally dispense two or more flowable products at a substantially constant, predetermined ratio. The present invention also pertains to a method of making such plural-chambered dispensing devices.

BACKGROUND OF THE INVENTION

Many chemical systems require two or more components to be kept separate before they are mixed and used in order to achieve certain desired properties. Such systems include epoxy adhesives, detergent and bleach combinations, detergent and fabric softener combinations, beverages, and foodstuffs. In such systems, it is usually important for the relative proportions of the components to remain within certain limits to achieve optimal results.

When different amounts of such multi-component systems are needed, it has been generally necessary to first weigh-measure or volume-measure the components separately and then mix them by hand. In addition to being time consuming and messy, such systems are impractical because weighing or measuring devices are typically not available at the place where such multi-component systems are to be applied. Few households, for example, have measuring devices that permit proper proportioning of components in small quantities, and estimating proportions by eye is not only difficult, but risks failure in achieving the proper proportions and the corresponding optimal characteristics of the chemical system.

There have been many attempts to provide plural-chambered dispensing devices that co-dispense two or more flowable products. However, in trying to maintain a constant pouring or dispensing ratio between the poured products, most of these devices require complex and expensive features which make the devices difficult and impractical to manufacture. In addition, the particular structure of these devices usually do not provide the degree of metering accuracy necessary for certain co-dispensing applications. For example, U.S. Pat. Nos. 2,661,870; 3,206,074; and 3,729,553 disclose dual-chambered containers that rely on different sized dispensing outlets, i.e., restricted orifices, to properly control fluid flow of the liquids dispensed therefrom. In U.S. Pat. Nos. 2,941,696; 2,973,883; 3,255,926; 3,416,709; and 3,776,775; a pressurized propellant (aerosol) is used to dispense the materials, which of course adds costs and requires outer containers that are strong enough to contain the propellant. In U.S. Pat. No. 3,851,800, the dual-chambered container disclosed therein meters the liquids within the chambers by controlling the venting of air into the chambers through air venting tubes. Besides being susceptible to clogging, such air venting tubes significantly increase the cost of such a container.

In light of the above, a principal object of the present invention is to provide a plural-chambered dispensing device that simultaneously dispenses two or more flowable products at a constant, predetermined ratio.

Another object of the present invention is to provide a dispensing device that uses gravity alone to dispense two or more flowable products at a constant predetermined ratio, thereby eliminating pressure generating means such as aerosol propellants.

A further object of the present invention is to provide a plural-chambered dispensing device that has no moving parts or restricted dispensing orifices that can become clogged.

It is another object of the present invention to simultaneously dispense constant proportions of a multi-component pourable system by placing the individual components in a rigid, portable container while keeping the components isolated from one another until they are dispensed.

Another object of the present invention is to provide a plural-chambered dispensing device with a unique pouring spout that simultaneously pours and admixes the pourable products contained therein when the device is placed in its dispensing position.

A further object of the present invention is to provide a plural-chambered dispensing device with a unique sealing cap that substantially prevents premature admixing of the pourable product contained within the dispenser.

SUMMARY OF THE INVENTION

In accomplishing the above-stated objectives, the present invention provides a plural-chambered dispensing device having an inner container (inner chamber) positioned within an outer container (outer chamber). Since the inner container is positioned within the outer container, its presence influences the pouring characteristics of the pourable product contained within the outer container. Therefore, if a predetermined pouring ratio is to be maintained from the first pour to the last pour, i.e., incrementally, the effect of the inner container's presence within the outer container must be compensated for. In one preferred embodiment of the present invention, an empty third container (third chamber) is placed within the inner container to impose on the inner chamber a condition or effect similar to that imposed on the outer chamber by the inner container.

Another particularly preferred way of obtaining a constant pouring ratio by compensating for the inner container's presence within the outer container is to accurately size, shape, and position the inner container within the outer container such that the inner container's size, shape, and position substantially duplicates the effect of the empty third container mentioned above.

The present invention also provides a method of making plural-chambered containers of the present invention. In order to achieve low dispensing ratios of, for example, 3:1 or 4:1, the inner container must have a relatively large volume with respect to the outer container's volume and be sized accordingly. In such instances, the outer dimensions of the inner container are typically larger than the outer container's discharge opening or mouth. Therefore, to place the inner container within the outer chamber, the inner container is first formed by utilizing a standard container making method such as extrusion or injection blow-molding. Thereafter, the inner container is collapsed by vacuum or mechanical means to an outer dimension smaller than the outer container's discharge opening, followed by inserting the collapsed inner container within the major chamber. Once the inner container is in place, it is expanded back to its original size and shape by, for example, injecting the inner container with a pressurized gas or the pourable product to be contained within the inner container.

The present invention also provides a unique sealing cap that keeps the pourable products contained within the chambers isolated until simultaneous dispensing and mixing are desired, and a unique pouring spout that converges and mixes the stream of the pourable products when plural-chambered dispensing devices of the present invention are placed in their pouring or dispensing position.

BRIEF DESCRIPTION OF THE DRAWINGS

While the specification concludes with claims that particularly point and distinctly claim the subject matter regarded as forming the present invention, it is believed that the invention will be better understood from the following description and drawings in which:

FIG. 5 is a schematic cross-sectional side view of a plural-chambered dispensing device having one level of inner container compensation;

FIG. 6 is a schematic cross-sectional top plan view of the plural-chambered dispensing device illustrated in FIG. 5 taken along section line 5—5;

FIG. 7 is a schematic cross-sectional side view of a plural-chambered dispensing device having two levels of inner container compensation;

FIG. 8 is a schematic cross-sectional top plan view of the dispensing device illustrated in FIG. 7 taken along section line 8—8;

FIG. 9 is a schematic perspective view of the dispensing device illustrated in FIGS. 7 and 8, said dispensing device being made of a transparent material to show inner detail;

DETAILED DESCRIPTION OF THE INVENTION

Figure 1:
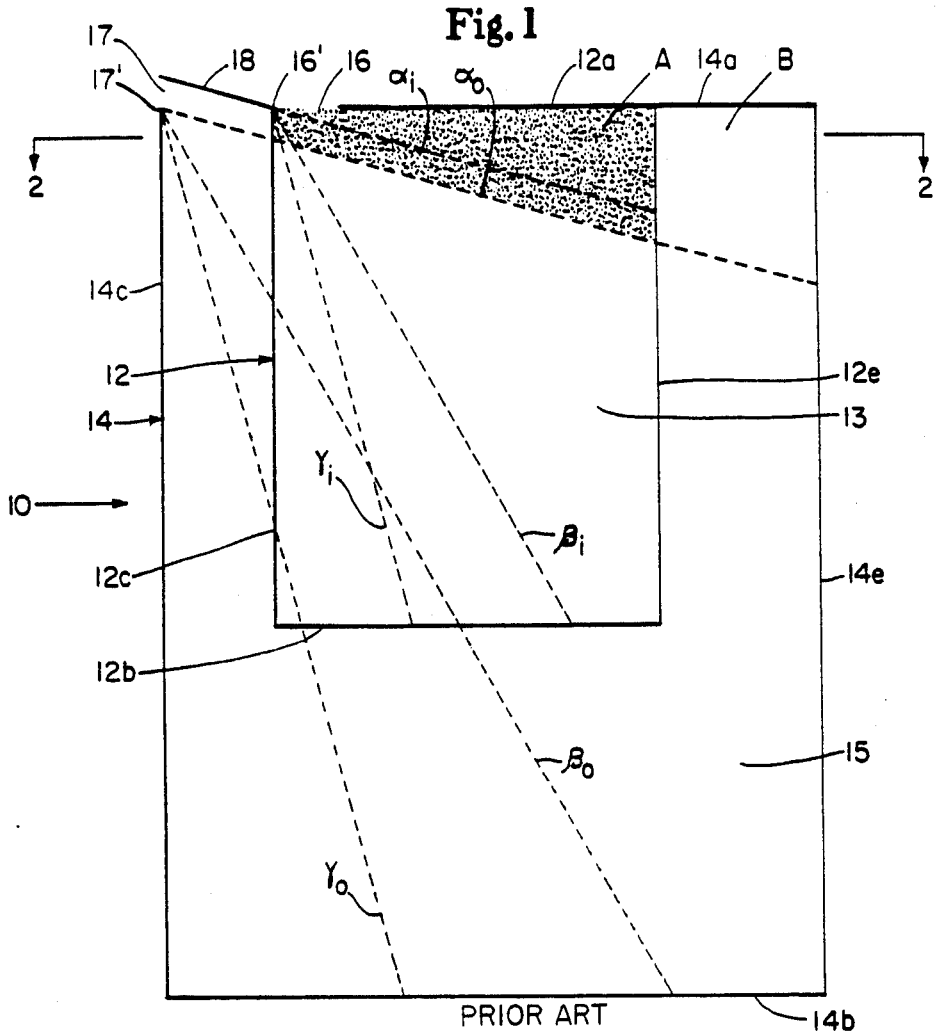
FIG. 1 is a schematic cross-sectional side view of a prior art dual-chambered dispensing device that does not provide a constant dispensing ratio over a wide range of incremental pours.
Figure 2:
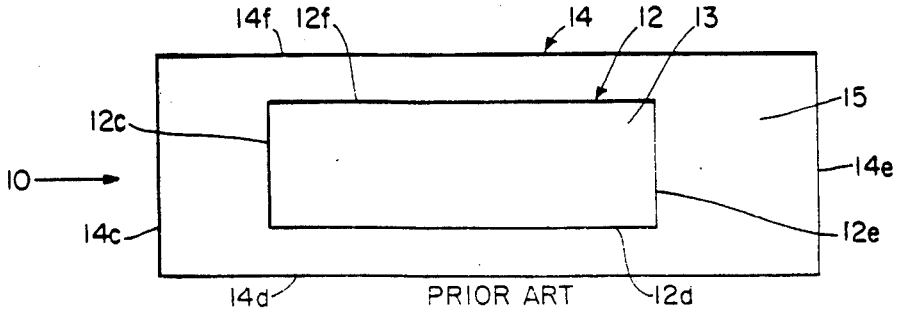
PRIOR ART Fig. 2
FIG. 2 is a schematic cross-sectional top plan view of the dual-chambered dispensing device illustrated in FIG. 1 taken along section line 2—2 of FIG. 1.

To aid in the understanding of the present invention, it is believed that a brief discussion of a major problem associated with achieving a constant pouring ratio with a plural-chambered dispensing device would be helpful. Accordingly, FIGS. 1 and 2 are schematic cross-sectional side and top views, respectively, of a prior art, plural-chambered, gravity-activated dispensing device 10 that simultaneously dispenses two flowable products when device 10 is tipped to its dispensing position, i.e., rotated to the left with respect to the vertical axis.

Prior art dispensing device 10 comprises an inner container 12 located within outer container 14. Inner container 12 has a top panel **12*a*, bottom panel 12*b*, and side panels 12*c*, 12*d*, 12*e*, and 12*f* which collectively define inner chamber 13. Outer container 14 has a top panel 14*a*, bottom panel 14*b*, and side panels 14*c*, 14*d*, 14*e*, and 14*f* which collectively define outer chamber 15. Both containers 12 and 14 have a flowable product contained therein, and have discharge openings 16 and 17, respectively. Inner container 12 is also provided with pouring surface 18 which channels the pourable product inside inner chamber 13 over and beyond discharge opening 17 of outer container 14 when device 10** is tipped.

When prior art dispensing device 10 is tipped 90° to the left with respect to the vertical axis to dispense the pourable products within both chambers, i.e., a complete or "one-shot" pouring operation, the end result is a constant dispensing ratio of X:1. However, because of the presence of inner container 12 within outer chamber 15, it can be shown that there is a wide variation from the "one-shot" dispensing ratio X:1 when dispensing device 10 undergoes incremental, i.e., partial pouring operations.

To illustrate, when dispensing device 10 is rotated 15° to the left, the volume of the flowable product dispensed from inner chamber 13 ($V_I$) is the volume of three-dimensional wedge marked "A" defined by discharge opening pour point 16' as the vertex, the plane of the flowable product's top surface at the commencement of pouring (**12*a*), the plane of the flowable product's top surface at the cessation of pouring (marked as dashed line "$\alpha_i$"), and the inner surface of inner container 12 between the two planes as the periphery (corresponding portions of 12*d*, 12*e*, and 12*f*). Similarly, the volume of the flowable product dispensed from outer chamber 15 ($V_o$) is the total volume of three-dimensional wedge marked "B" ($V_{OT}$) defined by discharge opening pour point 17' as the vertex, the plane of the flowable product's top surface at the commencement of pouring (14*a*), the plane of the flowable product's top surface at the cessation of pouring (marked as dashed line "$\alpha o$"), and the inner surface of outer container 14 between the two planes as the periphery (corresponding portions of 14*d*, 14*e*, and 14*f*), with the volume that inner container 12 displaces ($V_{ID}$) within wedge "B" of outer container 14** (shaded area) subtracted therefrom. After calculating inner container dispensed volume $V_I$, total volume of outer container $V_{OT}$, and volume of inner container displaced volume $V_{ID}$ as just described, the dispensing ratio (D.R.) can be calculated by using the following equation:

$$D.R. = \frac{V_T - V_{ID}}{V_I} = \frac{V_o}{V_I}$$

The dispensing ratio of dispensing device 10 rotated from 60° to 75° and from 75° to 90° (empty condition) can be calculated by using the same technique described above with respect to dashed lines "$\beta_i$, $\beta_o$" and "$\gamma_i$, $\gamma_o$" as shown in FIG. 1.

To illustrate the wide variation in dispensing ratios over a range of incremental pours, the dispensing ratios of an actual dispensing device having an objective dispensing ratio of 4:1 and a corresponding outer container having x, y, and z-direction dimensions of 4.5"×6.0"×1.5" (40.50 in$^3$), and an inner container of 2.84"×3.78"×0.95" (10.2 in$^3$), are presented in Table 1 below.

TABLE 1

| | $V_{IT}$ | $V_{OT}$ | $V_{ID}$ | $V_O$ | D.R. |
|---|---|---|---|---|---|
| 0°-15° | .83 | 4.07 | 1.28 | 2.79 | 3.36 |
| 60°-75° | 1.67 | 8.36 | 1.18 | 7.18 | 4.30 |
| 75°-90° | 1.45 | 7.23 | 0.06 | 7.17 | 4.94 |

where $V_I$=inner container dispensed volume (in.$^3$)
where $V_{OT}$=outer container total volume (in.$^3$)
where $V_{ID}$=inner container displacement in outer container (in.$^3$)
where $V_O=V_{OT}-V_{ID}$=outer container dispensed volume (in.$^3$)
where D.R.$=V_O/V_I$=dispensing ratio As Table 1 shows, a dispensing device having an objective or "one operation" dispensing ratio of 4.0:1 can vary all the way from 3.36:1 for an initial incremental pour to 4.94:1 for the final incremental pour. Most chemical systems require a dispensing device that has a much higher degree of metering accuracy than this to achieve optimal results.

Figure 3:
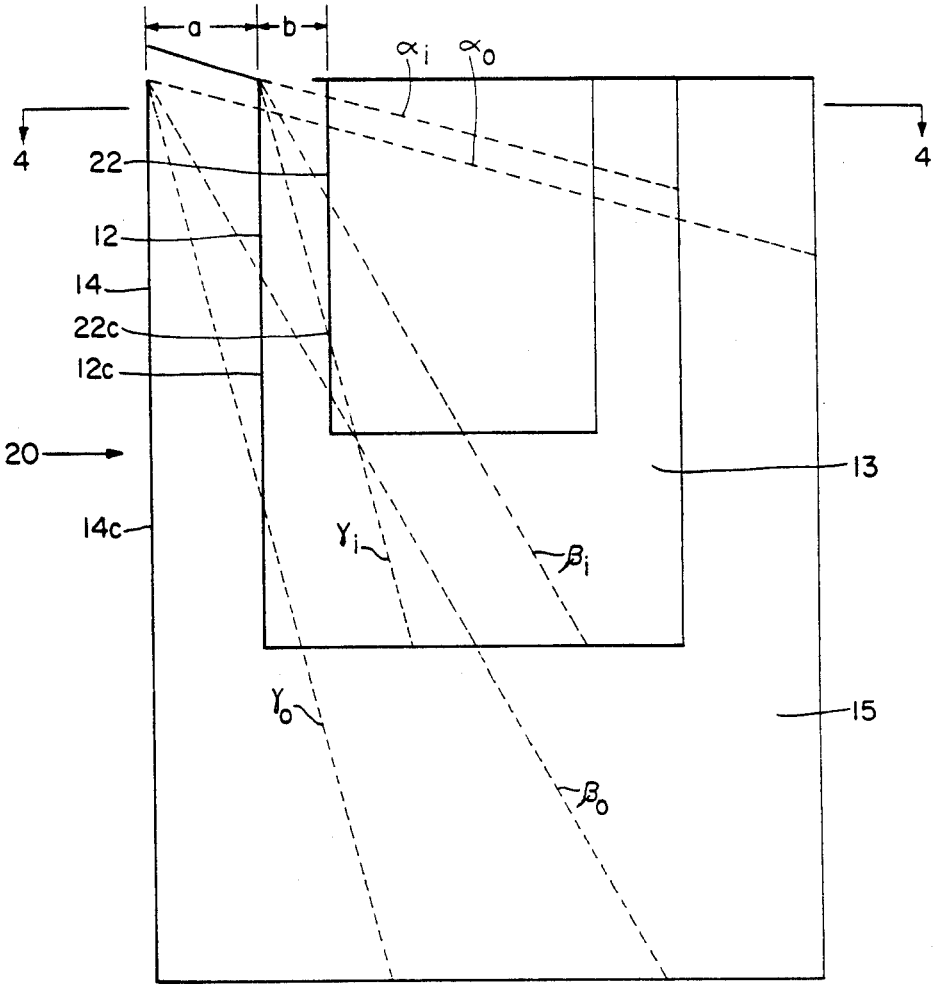
FIG. 3 is a schematic cross-sectional side view of a plural-chambered dispensing device that does provide a substantially constant dispensing ratio over a wide range of incremental pours.
Figure 4:
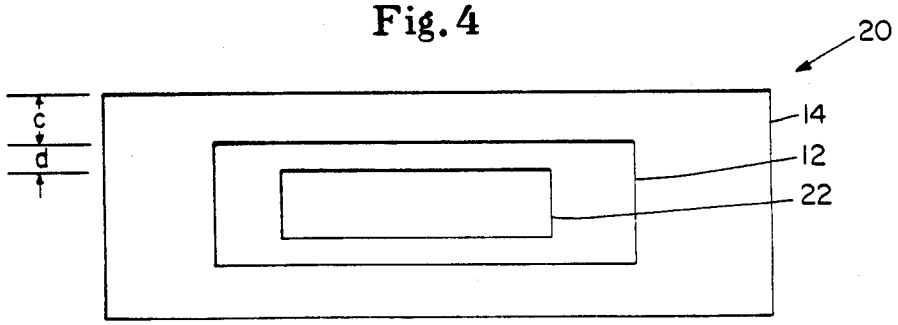
FIG. 4 is a schematic cross-sectional top plan view of the plural-chambered dispensing device illustrated in FIG. 3 taken along section line 4—4.

The present invention provides a plural-chambered, gravity-activated dispensing device that can deliver a substantially constant, predetermined pouring ratio from the initial to the final incremental pour. This objective is achieved by compensating for the effect that the inner container's presence within the outer chamber has on the outer container's pouring characteristics. Referring to FIGS. 3 and 4, there is illustrated a preferred dispensing device 20 which compensates for the presence of inner container 12 within outer chamber 15 by having empty third container 22 within inner chamber 13. Third container 22 is sized and positioned within inner container 12 such that third container 22 presents an effect on the pouring characteristics of inner container 12 that is similar to the effect that inner container 12 has on the pouring characteristics of outer container 14. To properly size and position empty third container 22, the size and location relationship between inner container 12 and outer container 14 must first be analyzed. In this regard, it can be demonstrated that for any objective dispensing ratio X, the dimensional relationship between inner container 12 with respect to outer container 14 in the x, y, and z-directions is governed by the relationship:

$$\text{dimension (inner)} = \text{dimension (outer)} \times \frac{1}{\sqrt[3]{X}}$$

Similarly, as with the relationship between inner container 12 and outer container 14, it can be shown that the dimensional relationship between inner container 12 and empty third container 22 is governed by equation:

$$\text{dimension (third)} = \text{dimension (inner)} \times \frac{1}{\sqrt[3]{X}}$$

Positioning empty third container 22 within inner container 12 is governed by a similar relationship. Referring to FIGS. 3 and 4, the x-direction distance between side panel 14c of outer container 14 and side panel 12c of inner container 12 is shown as dimension "a". Dimension "b", which is the distance between side panel 12c of inner container 12 and side panel 22c of empty third container 22 can be calculated from the following equation:

$$b = a \times \frac{1}{\sqrt[3]{X}}$$

Similarly, the positioning of empty third container 22 in the z-direction (FIG. 4) is governed by:

$$d = c \times \frac{1}{\sqrt[3]{X}}$$

To illustrate the compensation effect that empty third container 22 has on dispensing device 20, again assume that the object pouring ratio is 4:1 and that outer container 14 has dimensions 4.5"×6.0"×1.5" in the x, y, and z-directions, respectively. Given these starting points, inner container 12 would have dimensions 2.84"×3.78"×0.95"; and third container 22 would have dimensions 1.79"×2.38"×0.60". With x-dimension "a" of 0.75" and z-dimension "c" of 0.28", empty third container 22 is positioned within inner container 12 such that x-dimension "b" is 0.47" and z-dimension "d" is 0.47".

The volumes of pourable product dispensed from inner container 12 and outer container 14 can be calculated in the same manner as that for prior art dispensing device 10 shown in FIGS. 1 and 2 with reference to dashed lines "$\alpha_i$, $\alpha_o$"; "$\beta_i$, $\beta_o$"; and "$\gamma_i$, $\gamma_o$" in FIG. 3 which correspond to pouring angles 15°, 60°, and 75°, respectively. The volumes and dispensing ratios are shown in Table 2 below:

TABLE 2

| | $V_{it}$ | $V_{TD}$ | $V_i$ | $V_{OT}$ | $V_{ID}$ | $V_O$ | D.R. |
|---|---|---|---|---|---|---|---|
| 0-15° | 1.02 | 0.39 | 0.63 | 4.07 | 1.56 | 2.51 | 3.98 |
| 60°-75° | 2.09 | 0.39 | 1.70 | 8.35 | 1.56 | 6.79 | 3.99 |
| 75°-90° | 1.81 | 0.03 | 1.78 | 7.24 | 0.12 | 7.12 | 4.00 |

where $V_{iT}$=inner container total volume (in.$^3$)
where $V_{TD}$=third container displacement in inner container volume (in$^3$)
where $V_i=V_{IT}-V_{TD}$=inner container dispensed volume (in$^3$)
where $V_{OT}$=outer container total volume (in$^3$)
where $V_{ID}$=inner container displacement in outer container volume (in$^3$)
where $V_O=V_{OT}-V_{ID}$=outer container dispensed volume (in$^3$)
where D.R.$=V_O/V_i$=dispensing ratio As Table 2 shows, empty third container 22 does indeed create the same effect on the pouring characteristics of inner container 12 as inner container 12 has on the pouring characteristics of outer container 14. By doing so, the dispensing ratio of dispensing device 20 is maintained substantially constant over incremental pours.

Of course, as persons skilled in the art will recognize, placing third empty container 22 inside dispensing device 20 does result in an inefficient use of space, which in the case of containers, it is critically important to efficiently use. Therefore, in the particularly preferred embodiment of the present invention, the objective is to superimpose on inner container 12 the effect that empty third container 22 has on the system and thereby eliminate empty third container 22. This is accomplished by providing inner container 12 with a series of indentations and protrusions which mimmick the compensatory effect that empty container 22 has on the system.

Figure 11:
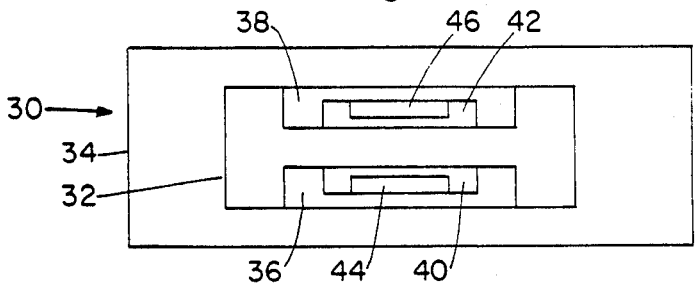
FIG. 11 is a schematic cross-sectional top plan view of the dispensing device illustrated in FIG. 10 taken along section line 11—11.
Figure 10:
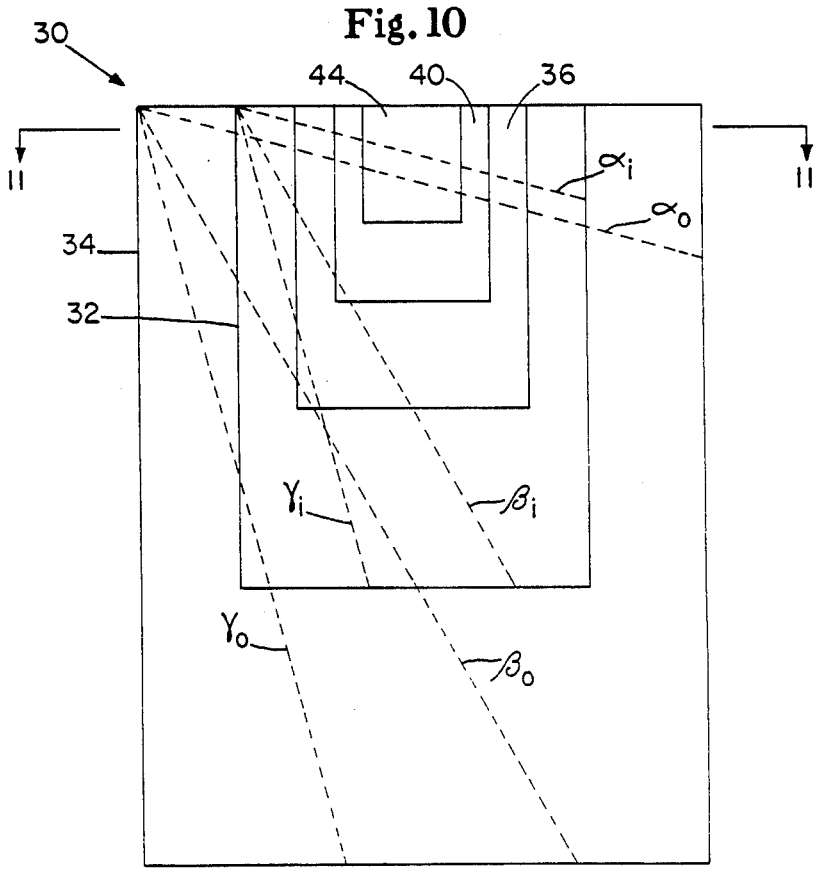
FIG. 10 is a schematic cross-sectional side view of a plural-chambered dispensing device having three levels of inner container compensation and exhibiting a substantially constant dispensing ratio over a wide range of incremental pours.

FIGS. 5, 7, and 10 and corresponding top view FIGS. 6, 8, and 11 illustrate iterative steps which superimpose empty third container 22 of dispensing device 20 shown in FIG. 3 onto inner container 32 of dispensing device 30 shown in FIGS. 5, 7, and 10. Referring first to FIGS. 5 and 6, the first step is to provide the outer surface of inner container 32 with indentations 36 and 38 of determined size and location. The procedure for sizing and positioning indentations 36 and 38 on the outer surface of inner container 32 is to take empty third container 22 of FIG. 3 and split it into two equal sections in the x-direction, followed by moving the two equal sections out in the z-direction and subtracting their volumes from the outer surface of inner container 32, as shown in FIGS. 5 and 6. Of course, by providing the outer surface of inner container 32 with indentations 36 and 38, the volume of outer container 34 is increased while the volume of inner container 32 is decreased. Therefore, the effects of indentations of 36 and 38 must be compensated for, which is shown in FIGS. 7 and 8.

In FIGS. 7 and 8, the outer surface of inner container 32 is provided with projections 40 and 42, which again must be of certain size and location. The size and location of projections 40 and 42 can be calculated in the same manner as indentations 36 and 38. Specifically and with reference back to FIGS. 3 and 4, the dispensing device shown therein would first be provided with a phantom empty fourth container (not shown) located within empty third container 22, said phantom empty fourth container having dimensions calculated by taking the dimensions of empty third container in the x, y, and z-directions and multiplying them by the factor $1/\sqrt[3]{X}$ where X is the object dispensing ratio. Similarly, the location of empty fourth container would be calculated by taking the location of empty third container 22 with respect to inner container 12, i.e. dimensions "b" and "c", and multiplying them by the factor $1/\sqrt[3]{X}$ where X again is the object dispensing ratio. Once properly sized and located, the empty phantom fourth container would be split in half in the x-direction, then moved out to the outer surface of inner container 32 in the form of projections 40 and 42 as shown in FIGS. 7 and 8.

FIG. 9 is a perspective view of what a transparent dispensing device 30 would look like after inner container 32 has been provided with two levels of compensation, i.e., indentations 36 and 38, and projections 40 and 42. Again, the function of indentations 36 and 38 and projections 40 and 42 is to eliminate empty third container 22 of pouring device 20 shown in FIGS. 3 and 4 and yet mimmick the effect that empty third container 22 had on the pouring characteristics of dispensing device 20.

It has been found that after two iterations of providing inner container 32 with indentations and projections (two levels of compensation), the objective dispensing ratio X is approached for any incremental dispensing pour with a degree of accuracy that is decisively better than that exhibited by uncompensated prior art dispensing device 10 shown in FIGS. 1 and 2. In those chemical system applications which require even greater accuracy, a third level of compensation can be provided as is the case shown in FIGS. 10 and 11. In FIGS. 10 and 11, the outer surface of inner container 32 of dispensing device 30 is provided with indentations 44 and 46 which are sized and located in the same manner as indentations 36 and 38 and projections 42 and 44, i.e. starting with a fifth phantom empty container that is sized and located in the x, y, and z-directions with respect to the fourth phantom empty container by using the factor $1/\sqrt[3]{X}$ where X is the objective dispensing ratio, followed by splitting the fifth phantom empty container in half and superimposing it on the surface of inner container 32 in the form of indentations 44 and 46.

After 3 levels of compensation, dispensing device 30 reaches a level of accuracy that is sufficient for most chemical systems. To illustrate, dispensing device 30 shown in FIG. 10 is provided with pouring angles 15°, 60°, and 75° marked as dashed lines "$\alpha_i$, $\alpha_o$"; "$\beta_i$, $\beta_o$"; and "$\oplus_i$, $\gamma_o$", respectively. For each incremental pouring angle, the volume of flowable product dispensed from inner container 32 and outer container 34 can be calculated by using simple geometry. For example, again assuming an objective dispensing ratio of 4:1, the amounts of flowable product dispensed from dispensing device 30 having an outer container of 4.5"×6.0"×1.5" and an inner chamber having overall dimensions of 2.84"×3.78"×0.95" are given in Table 3 below:

TABLE 3

| | $V_o$ | $V_I$ | D.R. | deviation |
|---|---|---|---|---|
| 0°–15° | 2.97 | 0.72 | 4.12 | 3% |
| 60°–75° | 6.81 | 1.70 | 4.01 | 0.25% |
| 75°–90° | 7.11 | 1.78 | 3.99 | 0.25% |

where $V_o$=outer container dispensed volume (in.$^3$)
where $V_i$=inner container dispensed volume (in.$^3$)
where D.R.=$V_o/V_i$=dispensing ratio Therefore, as Table 3 shows, after only three levels of compensation, the dispensing device shown in FIG. 9 dispenses two flowable products at a pouring ratio that is substantially constant over a wide range of pouring increments. Of course, four, five and even as many as six iterations can be performed for even greater accuracy.

Figure 12:
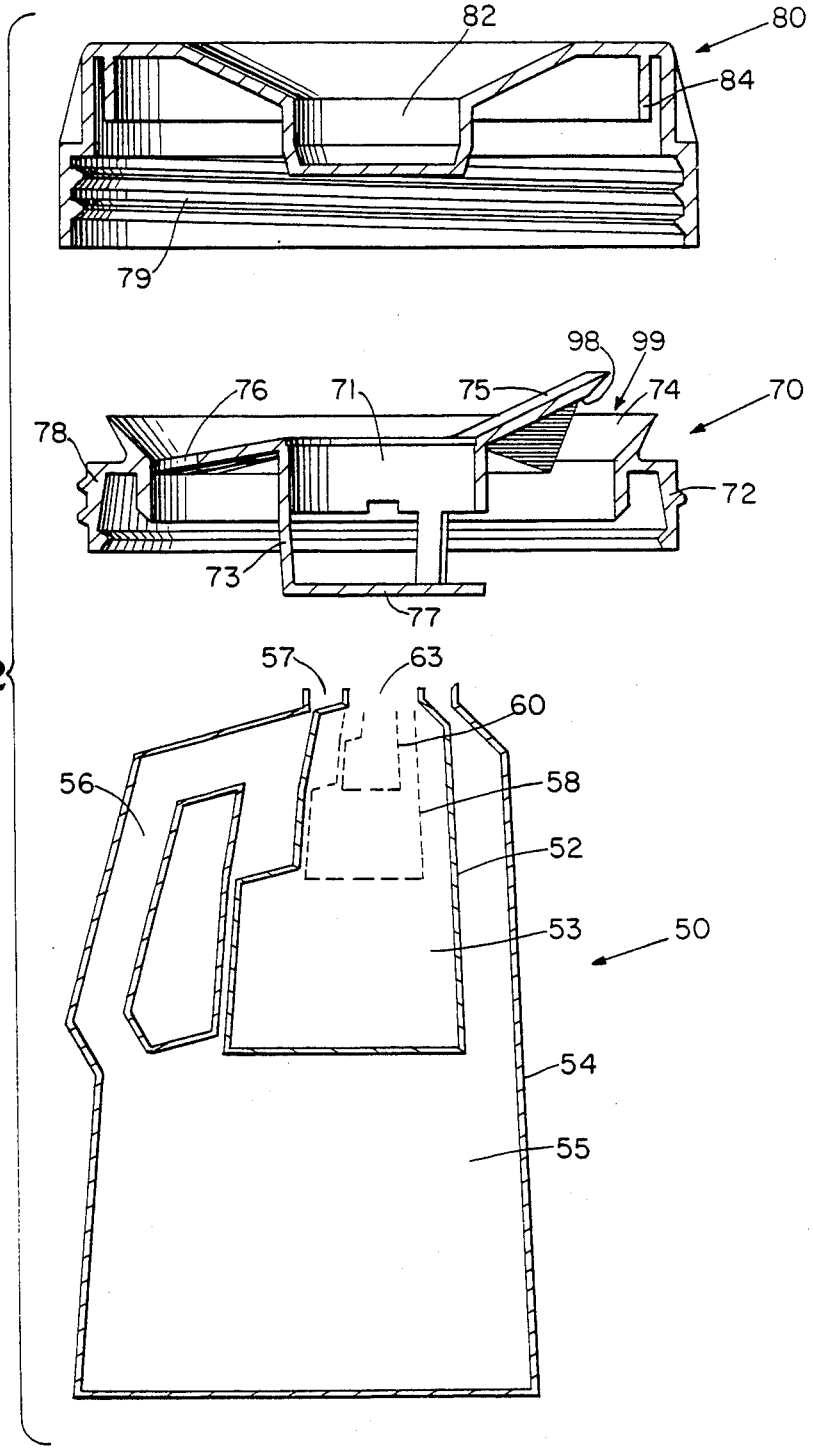
FIG. 12 is an exploded cross-sectional side view of a plural-chambered dispensing device having a pouring spout (70) and sealing cap (80), both components being greatly enlarged to show detail.

Thus far, the dispensing devices described and illustrated have been of rectangular cross-section in order to better describe the present invention. However, the basic compensation principle of the present invention is equally applicable to dispensing devices having complex shapes. For example, dispensing device 50 illustrated in exploded view FIG. 12 has a shape and configuration typical of containers used today in, for example, the liquid detergent industry. In FIG. 12, dispensing device 50 comprises an outer container 54 having hollow handle 56 which collectively define outer chamber 55, and an inner container 52 disposed within outer container 54 which defines inner chamber 53. Also illustrated is phantom empty third container 58 and phantom empty fourth container 60, the volumes of which must be accurately superimposed onto the surface of inner container 52 in the form of projections and indentations as described above to obtain a substantially constant, predetermined dispensing ratio between the volume of flowable product dispensed from outer chamber 55 to the volume of flowable product dispensed from inner chamber 53. Of course, it is recognized that in practice, it will be advantageous to gradually smooth out the sharp edges of such projections and indentations to provide the inner container with a more aesthetically pleasing and easier to manufacture shape.

In making the dispensing device 50 illustrated in FIG. 12, inner container 52 and outer container 54 can be made from a wide variety of materials by utilizing standard container making techniques such as injection or extrusion blow molding in the case of thermoplastics. In those instances where a high dispensing ratio such as 10:1 is required, the outer dimensions of inner container 52 are usually smaller than discharge opening 57 of outer container 44; therefore, inner container 52 can be simply inserted through discharge opening 57. However, for low dispensing ratios such as, for example, 3:1 or 4:1, inner container 52 will typically have the outer dimensions that are greater in size than discharge opening 57 of outer container 54. In such a case, the preferred way to make dispensing device 50 is to first independently form inner container 52 and outer container 54, followed by collapsing, e.g. mechanically or with vacuum, inner container 52 to a size that will permit its insertion through discharge opening 57 of outer container 54. Once inner container 52 has been inserted within outer container 54, inner container 52 can be expanded back to its original size and shape by, for example, injecting a pressurized gas or the flowable product to be contained within inner container 52 into inner chamber 53. Preferably, inner container 52 is made from a material that is sufficiently resilient to survive this procedure and yet sufficiently rigid to maintain its shape after it has been expanded within outer container 54.

FIG. 12 also shows a unique pouring spout 70, greatly enlarged for detail, that can be attached to a dispensing device of the present invention such as dispensing device 50. Pouring spout 70 has an outer mounting flange 72 that is sealingly fitted, e.g., snap fitted, screwed, or adhered, to discharge opening 57 of outer container 54. Preferably, the outer surface of outer mounting flange 72 has screw threads 78 or other closure receiving means such as snap-on lugs. Pouring spout 70 also includes a dispensing passageway 99 which is formed between separator element 98 and outer pouring surface 74. The dispensing passageway 99 provides fluid communication between outer chamber 55 and the exterior of dispensing device 50 when device 50 is tipped to its dispensing position. Pouring spout 70 also has a vent/-drain-back aperture 76 to vent outer container 54 and also to provide a means to drain any pourable product remaining on outer pouring surface 74 back into outer chamber 55.

Pouring spout 70 also includes mounting flange 73 which is inserted into discharge opening 63 of inner container 52. Preferably, mounting flange 73 includes an anti-surge disk 77 which prevents the flowable product contained within inner chamber 53 from surging out of inner chamber 53 if dispensing device 50 is tipped too quickly, but does not restrict the flow of the pourable product. Inner pouring surface 75 of pouring spout 70 is located on the uppermost portion of separator element 98. Inner pouring surface 75, which is in exclusive fluid communication with inner dispensing aperture 71, provides a means to channel the flowable product contained within inner chamber 53 to the exterior of dispensing device 50. Preferably, outer pouring surface 74 and inner pouring surface 75 are arranged and sloped such that the two flowable products will converge and admix when dispensing device 50 is tipped to its dispensing position.

Further, since the constant dispensing ratio is maintained at all pouring angles, neither the inner pouring aperture 71 nor the outer dispensing passageway 99 are inundated with flowable product during the proportional dispensing operation.

FIG. 12 also shows a unique sealing cap 80 that is specifically adapted to be releasably secured to pouring spout 70. Sealing cap 80 includes plug member 82 that is shaped complementary to inner dispensing aperture 71 of pouring spout 70. When sealing cap 80 is applied to pouring spout 70 as by screwing sealing cap 80 onto pouring spout 70 by means of screw threads 79, plug 82 enters and sealingly engages inner dispensing aperture 71 to seal the pourable product contained within inner container 52. Sealing cap 80 also includes annulus 84 which engages outer pouring surface 74 when sealing cap 80 is applied to pouring spout 70. When annulus 84 is engaged with outer pouring surface 74, it prevents the flowable product contained within outer chamber 55 from being in fluid communication with inner dispensing aperture 71, thereby preventing premature admixing of the pourable products contained within inner chamber 53 and outer chamber 55.

Plural-chambered dispensing devices for dispensing flowable products at a constant, predetermined ratio are thus provided. The dispensing devices shown have been somewhat simplified so that a person skilled in the art may readily understand the preceding description and economically incorporate the present invention into other dispensing devices having more complex shapes by making a number of minor modifications and additions, none of which entail a departure from the spirit and scope of the present invention. Accordingly the following claims are intended to embrace such modifications.

What is claimed is:

1. A method of making a plural-chambered dispensing device for simultaneously dispensing at least two flowable products, said method comprising the steps of:

(a) forming an outer container defining an outer chamber and having an upper portion, said outer chamber being adapted to contain a first flowable product, said upper portion having a first discharge opening;

(b) forming an inner container defining an inner chamber adapted to contain a second flowable product, said inner container having a second discharge opening and being capable of exhibiting a collapsed and an uncollapsed state, said inner container having a cross-section which is greater than that of said first discharge opening when said inner container is in its uncollapsed state;

(c) forming a third empty container capable of exhibiting a collapsed and an uncollapsed state, said third container having a cross-section which is greater than that of said second discharge opening when said third empty container is in its uncollapsed state;

(d) collapsing said third empty container to its collapsed state, whereby said third container exhibits a cross-section which is smaller than that of said second discharge opening in said inner container;

(e) inserting said collapsed third empty container into said inner chamber through said second discharge opening of said inner container;

(f) collapsing said inner container to its collapsed state, whereby said inner container exhibits a cross-section which is smaller than that of said first discharge opening in said outer container;

(g) inserting said collapsed inner container having said collapsed third empty container therein into said outer chamber through said first discharge opening of said outer container; and (h) returning said inner container and said third empty container to their said uncollapsed states.

2. The method recited in claim 1 wherein said outer, said inner, and said third empty containers are formed by extrusion blow-molding.

3. The method recited in claim 1 wherein said outer, said inner, and said third empty containers are formed by injection blow-molding.

4. The method recited in claim 1 wherein said inner container and said third empty container are collapsed by applying mechanical pressure thereto.

5. The method recited in claim 1 wherein said inner container and said third empty container are collapsed by applying fluid pressure thereto.

6. The method recited in claim 1 wherein said inner container is returned to its said uncollapsed state by injecting a pressurized gas into said inner chamber through said second discharge opening of said inner container.

7. A method of making a plural-chambered dispensing device for simultaneously dispensing at least two flowable products, said method comprising the steps of:

(a) forming an outer container defining an outer chamber and having an upper portion, said outer chamber being adapted to contain a first flowable product, said upper portion having a first discharge opening;

(b) forming an inner container defining an inner chamber adapted to contain a second flowable product, said inner container having a second discharge opening and being capable of exhibiting a collapsed and an uncollapsed state, said inner container having a cross-section which is greater than that of said first discharge opening when said inner container is in its uncollapsed state, said inner container also having a fixed predetermined shape and size while in its uncollapsed state;

(c) collapsing said inner container to its collapsed state;

(d) inserting said collapsed inner container into said outer chamber through said first discharge opening of said outer container;

(e) fixedly securing said collapsed inner container in a predetermined position within said outer chamber; and (f) returning said inner container to said fixed predetermined shape and size in said uncollapsed state and spaced from a major portion of the inside surface of said outer chamber.

8. The method recited in claim 7 wherein said outer and said inner containers are formed by extrusion blow-molding.

9. The method recited in claim 7 wherein said outer and said inner containers are formed by injection blow-molding.

10. The method recited in claim 7 wherein said inner container is collapsed by applying mechanical pressure thereto.

11. The method recited in claim 7 wherein said inner container is collapsed by applying fluid pressure thereto.

12. The method recited in claim 7 wherein said inner container is returned to its said uncollapsed state by injecting a pressurized gas into said inner chamber through said second discharge opening of said inner container.

13. The method recited in claim 7 wherein said inner container is returned to its said uncollapsed state by injecting said second flowable product into said inner chamber through said second discharge opening of said inner container.

* * * * *